United States Patent [19]

Kunttu et al.

[11] 4,331,087

[45] May 25, 1982

[54] METHOD AND APPARATUS FOR FORMING A TURBULENT SUSPENSION SPRAY FROM A PULVEROUS MATERIAL AND REACTION GAS

[75] Inventors: Kalevi J. Kunttu, Espoo; Launo L. Lilja; Valto J. Mäkitalo, both of Pori, all of Finland

[73] Assignee: Outokumpu Oy, Helsinki, Finland

[21] Appl. No.: 105,556

[22] Filed: Dec. 20, 1979

[30] Foreign Application Priority Data

Dec. 21, 1978 [FI] Finland ..... 783961

[51] Int. Cl.[3] ..... F23D 1/02

[52] U.S. Cl. ..... 110/264; 110/347; 239/402.5; 239/403; 239/420; 239/424

[58] Field of Search ..... 110/264, 263, 347; 239/402.5, 403, 404, 406, 420, 423, 424

[56] References Cited

U.S. PATENT DOCUMENTS 4,146,359 3/1979 Lumpkin et al. ..... 110/264 X

FOREIGN PATENT DOCUMENTS 342294 1/1931 United Kingdom ..... 110/264

*Primary Examiner*—Edward G. Favors

*Attorney, Agent, or Firm*—Brooks, Haidt, Haffner & Delahunty

[57] ABSTRACT

A method for forming a turbulent suspension from a pulverous material and reaction gas by causing the pulverous material to flow downwards as an annular flow into the reaction chamber and by directing the reaction gas downwards inside the annular flow of the pulverous material, in which the suspension is produced by bringing the reaction gas into a high-force rotary motion and by then causing it, throttled, to discharge into the reaction chamber so that in the reaction chamber it meets on its outside a substantially vertically downward annular flow of the pulverous material, this flow being formed by utilizing the kinetic energy of the falling pulverous material on a convergent conical glide surface. An apparatus for forming a turbulent suspension from a pulverous material and reaction gas, which apparatus is adapted to be directed centrally downwards into the reaction chamber and consists of a feed pipe for the pulverous material, means for dividing the pulverous material and of a turbulence chamber for reaction gas, in which the feed pipe for the pulverous material has the shape of a downwards convergent cone, and inside the feed pipe there is an axially mounted turbulence chamber at the upper section of which there is a turbulence generator, and the lower section of the turbulence chamber comprises a cylindrical stabilizing member with a diameter less than that of the turbulence chamber.

7 Claims, 7 Drawing Figures

METHOD AND APPARATUS FOR FORMING A TURBULENT SUSPENSION SPRAY FROM A PULVEROUS MATERIAL AND REACTION GAS

BACKGROUND OF THE INVENTION

The present invention relates to a method and apparatus for forming a turbulent suspension spray from a pulverous material and reaction gas by bringing the reaction gas into a highforce rotary motion in a turbulence chamber, from which it is caused to discharge into the reaction chamber, and by causing the pulverous material to run as an annular flow into the turbulent gas spray thus produced, in order to protect the walls of the reaction chamber from the effects of direct contact with the reaction gas.

There are two principles which are applied to feeding a suspension of reaction gas and a pulverous material into the reaction chamber. According to these principles, the suspension is formed either at a point before the actual injection device or by means of the injection device. The former method is used in the coal dust burners of conventional coal dust heating or in metallurgical apparatus in which a pneumatically conveyed, finely-divided ore or concentrate, together with its carrier gas, is injected into the reaction vessel. When this method is applied, the injection rate must be adjusted so as to prevent any blowback of reactions. When high degrees of preheating are used or in other cases in which the suspension formed is highly reactive, e.g. in oxidizing smelting of a metallurgical sulfidic concentrate, the suspension must be formed as close as possible to the reaction chamber or, preferably, in the reaction chamber, as set forth in the present invention.

The object of the present invention is to provide a suspension forming method in which the first contact between the reacting substances occurs in the reaction chamber, and so it is also suitable for forming a suspension from highly reactive substances.

According to the present invention there is provided a method for forming a turbulent suspension from a pulverous material and reaction gas by causing the pulverous material to flow downwards as an annular flow into the reaction chamber and by directing the reaction gas downwards inside the annular flow of the pulverous material, in the reaction gas is brought into a high-force rotary motion, throttled, and discharged into the reaction chamber so that in the reaction chamber it meets the substantially vertically downward annular flow of the pulverous material, this flow being preferably formed by utilizing the kinetic energy of the falling pulverous material on a convergent conical glide surface. According to the invention there is further provided an apparatus adapted to be directed centrally downwards into a reaction chamber and comprising a feed pipe for the pulverous material, means for distributing the pulverous material and a turbulence chamber for reaction gas, in which the feed pipe for the pulverous material has the shape of a downwards convergent cone, and inside the feed pipe there is an axially mounted turbulence chamber at the upper section of which there is a turbulence generator the lower section of the turbulence chamber comprising a cylindrical stabilizing member with a diameter less than that of the turbulence chamber.

The literature contains several descriptions of the feeding of suspension into a reaction chamber. Most of them concern either the direct injection of a pneumatically conveyed, finely-divided solid material, or the apparatus in which the suspension spray is formed by means of pressure pulses produced in the reaction gas by an ejecting-type method, whereafter the suspension is injected into the reaction chamber. Such a spray forms a cone with a flare angle in the order of 15°–20° and with the highest concentration of solid material in the center of the spray. The shape of the distribution is mainly dependent on the properties of the solid and on the suspension flow velocity. In this case, the solid and the gas flow in substantially the same direction.

As known, the transfer of mass between the reacting solid particle and the surrounding gas is essentially dependent on the velocity difference between them.

It is known and easy to calculate that, within the gas velocity ranges and with concentrate particle sizes normally used in metallurgical apparatus, any velocity difference between the concentrate particle and the gas tends to attenuate rapidly. For this reason it is important that the velocity difference necessary for the transfer of mass is produced between the solid material particles and the reaction gas at a reaction chamber spot where the prerequisites for the reactions do exist otherwise. In cases in which the reacting materials are mixed before the injection, the kinetic energy which produces velocity differences is usually at its highest at the injection point or before it. If, on the other hand, the mixing is carried out in the reaction chamber, it is possible to adjust the highest velocity difference so as to occur at the desired point.

In metallurgical processes, for example in flash smelting furnaces, the proportion of the solid material to the total mass of the suspension is important, especially at high degrees of oxygen concentration. Depending on the thickness of the lining of the reaction chamber top, on the location of the feeding devices, etc., the solid material has some distance to travel to the suspension formation point, and therefore the extent of its vertical motion is important. In conventional methods of forming a suspension, the solid material tends, owing to this extent of motion and to its slowness of mass, to attenuate the horizontal velocity component of the suspension-forming gas and thereby constrict the spray.

According to the present invention, the kinetic energy the solid material has while falling is utilized in forming an annular flow of a pulverous solid material, as even as possible, and to transfer this flow to a point advantageous for suspension formation, for reactions and for protection of the reaction chamber walls.

Therefore, the present invention relates to a method and apparatus for forming a turbulent suspension spray in a reaction chamber by utilizing pre-division of a flow of pulverous material and the directing of the kinetic energy of the formed partial flows in order to form, with the aid of a suitable surface, an annular flow of the pulverous material, and also by utilizing a reaction gas flow which has been brought into a high-force rotary motion and throttled in a turbulence chamber and discharges through a special stabilizing section, in order to produce a maximal velocity difference between the pulverous material particles and the reaction gas at a reaction chamber spot advantageous for the reactions to make effective use of the reaction chamber, and to prevent the unreacted gas from coming contact with the reaction chamber walls.

The kinetic energy of the spray of falling pulverous material can also be utilized in dividing the spray in to partial flows, either by dividing it directly into different flows by means of suitable walls and by known methods, or even more advantageously, in the suspension forming device by causing the pulverous material to glide as a thin layer along the interior wall of the cylindrical chamber, which evens it out, and by separating from it, by means of suitable stops, preferably triangular strips which are substantially transverse to the direction of gliding, partial flows of the desired extent, each located at a specific point.

According to our invention, the suspension spray is formed in the reaction chamber by devices mounted in its top, in the following manner, for example:

A flow which is divided into partial flows, or several partial flows, is/are formed by known methods from the pulverous material. The partial flows, directed downwards, are caused to impinge/glide, against an inclined surface/on an inclined surface, preferably a conical surface, which forms from the partial flows an even, annular flow of pulverous material, directed downwards towards a suotable point in the reaction chamber. The reaction gas is brought into a high-force turbulent motion in a special turbulence chamber and is allowed to discharge, parallel to the axis of rotation, through a throttling, preferably circular, outlet at the end of the turbulence chamber into a stabilizing member, which preferably comprises a tubular conduit having a diameter the ratio of which to the diameter of the turbulence chamber is preferably within the range 0.2–0.8, and from there on through a circular discharge outlet to inside the annular flow, substantially parallel to its axis. From this outlet, which opens directly into the reaction chamber, the highly turbulent, whirling spray discharges as a cone having a flare angle which can be adjusted within the range 15°–180° by controlling the conditions prevailing in the turbulence chamber. Thus, the meeting point of the annular flow of pulverous material and the reaction gas can be adjusted by controlling either the flowing point of the annular flow of pulverous material and/or the flare angle of the turbulent spray of the reaction gas.

Since the reaction gas is directed to inside the annular flow of pulverous material, it cannot come into contact with the reaction chamber walls without first meeting the pulverous material.

In practice, the spreading requirements are determined by the size of the reaction chamber and the turbulence degree requirements by the process conditions (grade of the concentrate, etc.).

DESCRIPTION OF THE PREFERRED EMBODIMENTS

Figure 1:
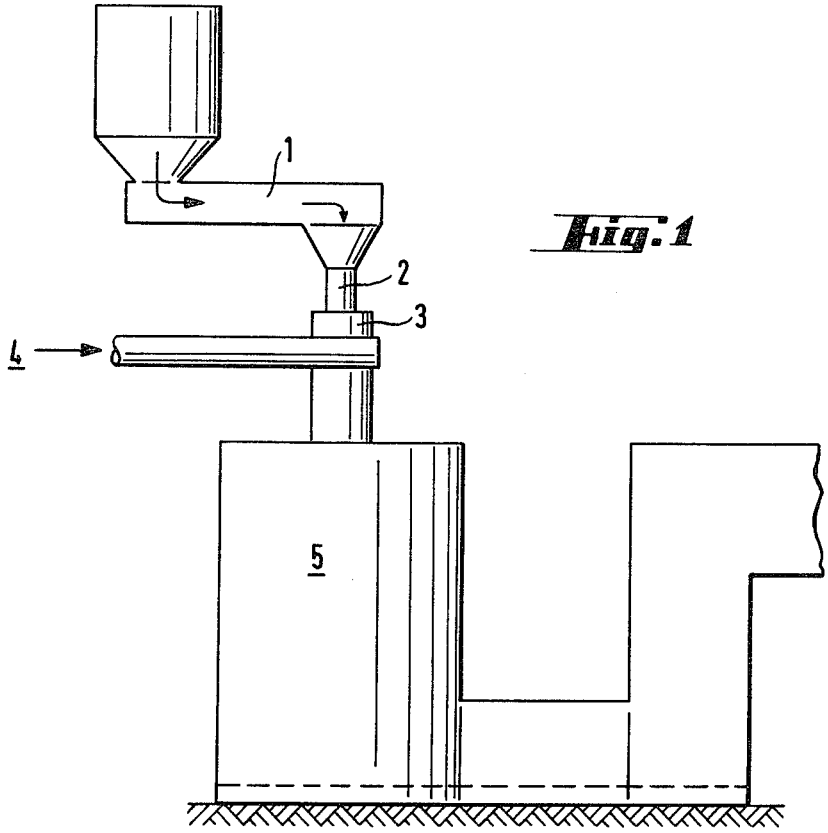
FIG. 1 is a diagrammatic representation of one object of application of our invention.

In FIG. 1, numeral 1 indicates a conveyor by means of which a pulverous material is conveyed to the upper end of the flow pipe 2 in such a manner that material falls continuously through the flow pipe 2 into the dividing device 3 and from there on into the suspension forming zone. Reaction gas 4 is fed inside the pulverous material into the reaction chamber 5.

Figure 2A:
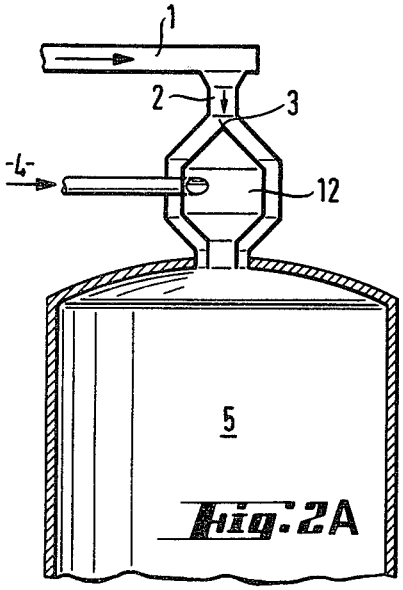
FIG. 2A depicts a diagrammatic vertical section of a preferred embodiment of the invention.

In FIG. 2A, the pulverous material flowing from the conveyor 1 through the flow pipe 2 is divided into partial flows by means of partitions 3, and the annular flow formed from these partial flows is directed into the reaction chamber 5. The reaction gas 4 is brought into a tangential turbulent motion in the turbulence chamber 12.

Figure 2B:
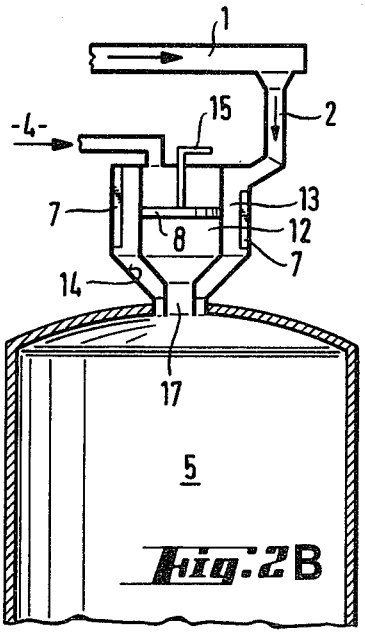
FIG. 2B depicts, also diagrammatically, a vertical section of another preferred embodiment of the invention.

In FIG. 2B, the pulverous material flowing from the conveyor 1 through the flow pipe 2 is directed tangentially into a cylindrical chamber 13, and the thinned flow of powder formed on its wall and rotating helically is directed as an annular flow via the outside of the turbulence chamber 12 into the reaction chamber. The reaction gas flow 4 is directed, through the turbulence generator 8 into the turbulence chamber 12.

Figure 3:
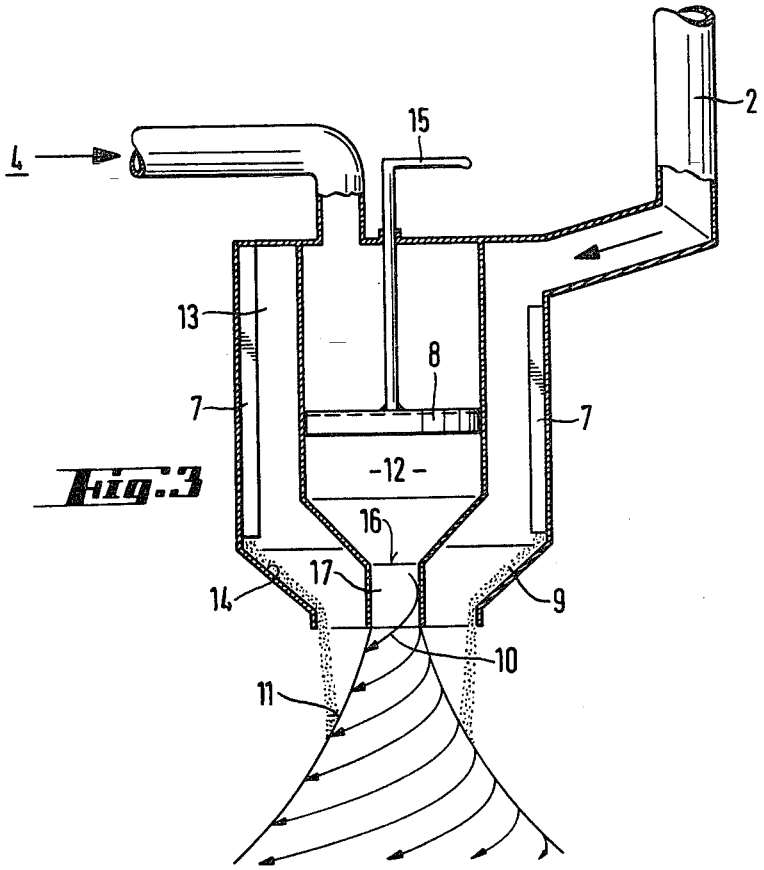
FIG. 3 depicts in more detail the apparatus of FIG. 2B and the suspension formation method.
Figure 6:
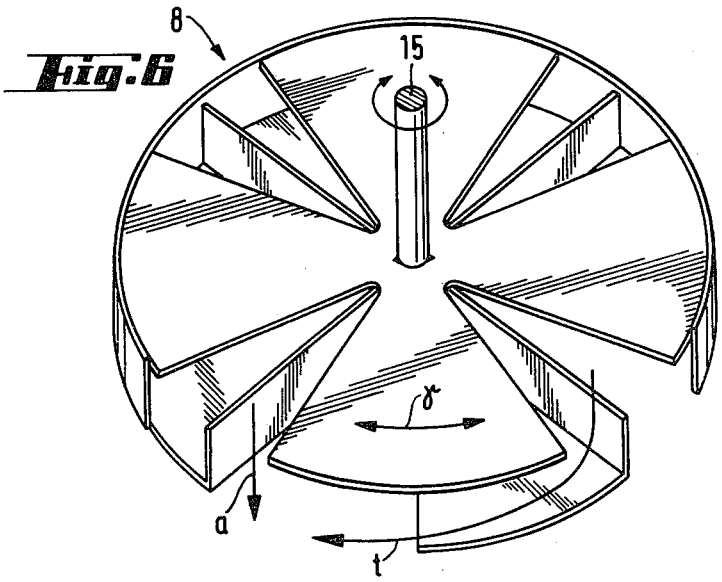
FIG. 6 depicts diagrammatically an adjustable turbulence generator 8 in a sectioned diagonal axonometric representation. The axial component of the partial flow is indicated by the arrow a and the tangential component by the arrow t.

In FIG. 3, the flow of pulverous material flowing from the flow pipe 2 is directed tangentially into a cylindrical chamber 13, and, thinned out, the pulverous material glides along its interior wall and meets advantageously transverse, triangular, oblong stops 7 which divide it into partial flows. These partial flows arrive on an interior conical surface 14, which forms from the flows an evened annular flow 9 of material. The reaction gas flow 4 is directed through a turbulence generator 8 into the turbulence chamber 12 and then through the circular outlet 16 at the end of the chamber 12 into the stabilizing section 17 and discharges as a turbulent gas flow 10 inside the annular spray of pulverous material in the reaction chamber. The force of the turbulence can be adjusted by controlling the turbulence generator 8 at point 15, whereby the meeting point 11 of the pulverous material and the reaction gas can be adjusted.

EXAMPLES

Example 1

A concentrate burner according to our invention (turbulence chamber diameter $D_1=186$ mm and height $h_1=50$ mm, discharge outlet diameter $d_2=100$ mm and height $h_2=100$ mm) was used in a semi-industrial-scale flash smelting furnace ($\phi$ 1.35 m), the conditions being $\dot{m}_{O2}=0.34$ kg/s, $\dot{m}_{concentrate}=0.56$ kg/s (range used 0.25–1.25 kg/s), and a temperature of 1700 K. prevailing in the reaction chamber. The rotary motion of the gas to be fed into the burner was produced by a controllable turbulence generator, the effect of the generator corresponding to the moment of rotation given by an outlet the size of the stabilizing member 17 (FIG. 3) directed tangentially to the outer periphery of the turbulence chamber which was perpendicular to the central axis.

The meeting point of the concentrate and oxygen was in this case 100 mm below the vault of the reaction shaft.

The oxidation results were in accordance with the requirements of the process. After a trial run of 500 h, using technical oxygen, no effects of burning or other deterioration were observable in the burner.

No growths appeared on the reaction chamber walls.

Example 2

Figure 4:
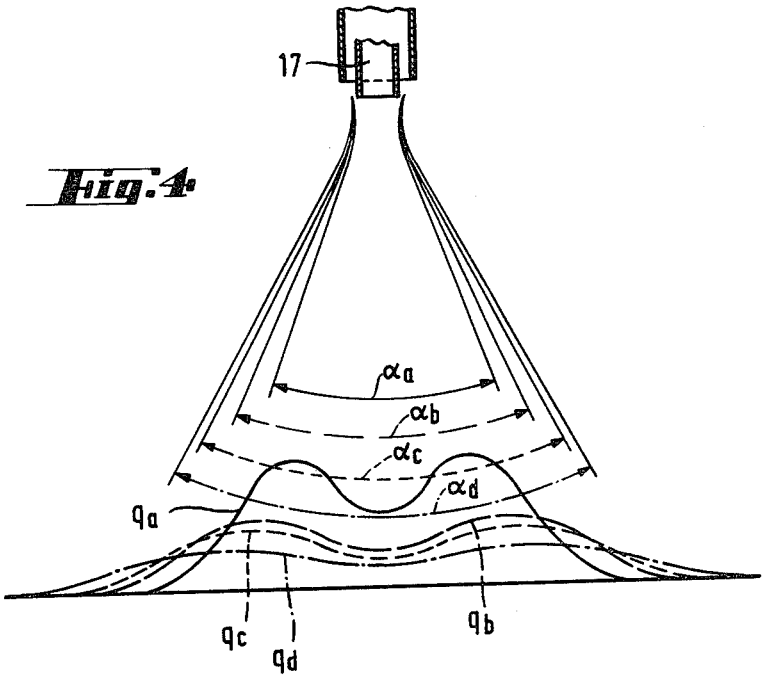
FIG. 4 depicts diagrammatically the vertical section of the concentrate spray described in Example 2 and the concentrate content in the spray at the horizontal level below the discharge outlet. $\alpha$ is the flare angle of the spray and q is the concentrate content.

Measurements of division of solid material in free space were performed as cold tests using the concentrate burner depicted in example 1. The solid material was fine sand; its feed rate was 0.6 kg/s and the gas used was air (0.36 kg/s). The purpose of the experiments was to investigate the effect of turbulence on the distribution of the solid material when using this apparatus structure. The results were recorded by photographing the suspension spray produced. The distribution of the solid material was measured along the horizontal level 2 m below the discharge outlet. The flare angles of the spray, measured from the photographs, and the distributions of solid material are depicted diagrammatically in FIG. 4, and the results of the measurements are given in Table 1, in which Γ indicates the rotational energy provided by the controllable turbulence generator, compared with the case of Example 1, and $r_{max}$ represents the distance, measured from the central axis of the spray, at which the quantity q of solid material arriving per one surface unit in a time unit reached its maximum value. γ is the setting of the turbulence generator; when it increases, the proportion of the tangential gas flows to the axial gas flows increases in the turbulence chamber. The spray was even and the suspension was well formed.

TABLE 1

| | γ | Γ/% | α/o | $r_{max}$ m | g kg/m$^2$ . s |
|---|---|---|---|---|---|
| a | 10 | 63 | 43 | 0.34 | 0.65 |
| b | 15 | 83 | 51 | 0.51 | 0.40 |
| c | 17 | 91 | 58 | 0.56 | 0.32 |
| d | 20 | 100 | 60 | 0.65 | 0.25 |

Example 3

Figure 5:
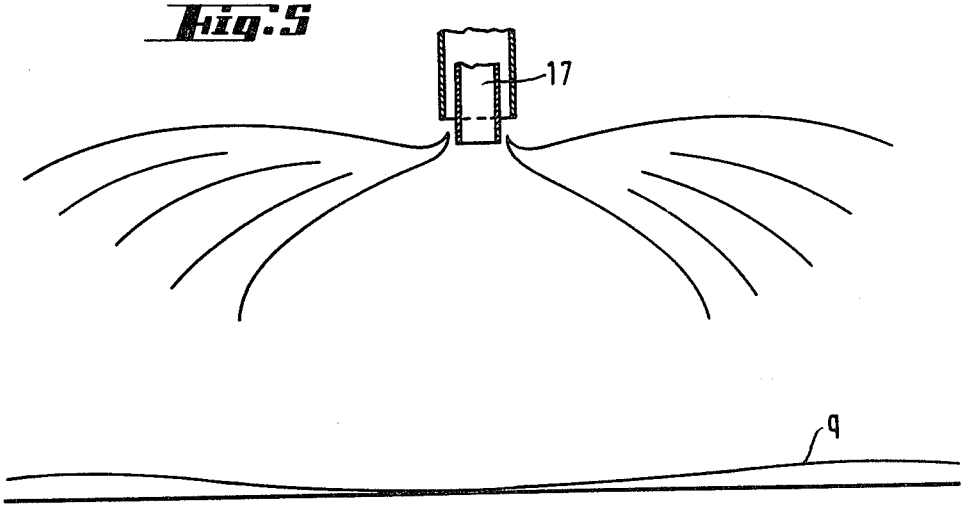
FIG. 5 is also a diagrammatic representation of the vertical section of the concentrate spray when the rotary effect of the turbulence generator and its discharge rate have been increased.

The spreading efficiency of the concentrate burner according to Example 2 was improved by increasing the rotary effect of the turbulence generator 8 so as to increase the rotational energy 4-fold. When the quantities of sand and air were in accordance with Example 2 and the setting of the turbulence generator in accordance with case a (γ=10), the spray and the distribution of solid material measured 1.7 m below the outlet were in accordance with FIG. 5. The spray was even and the suspension was well formed.

It can be observed on the basis of Examples 2 and 3 that the spreading of the suspension spray is strongly dependent not only on the dimensional proportions but also on the setting of the turbulence generator, which for its part has a strong effect on the degree of turbulence of the spray.

The invention is not limited to the methods and devices described above in the examples and depicted in the drawings, but it can be varied within the following patent claims.

What is claimed is:

1. A method of forming a turbulent suspension from a pulverous material and a reaction gas by causing the pulverous material to flow downwards as a substantially vertical annular flow into a reaction chamber and by directing the reaction gas downwards inside the annular flow of pulverous material, comprising causing the pulverous material to fall freely in the reaction chamber under the influence of gravity in an annular flow bringing the reaction gas into a high-force rotary motion and throttling the rotating flow of the reaction gas before the gas contacts the pulverous material, and discharging the gas into the reaction chamber at a flare angle so that in the reaction chamber the gas meets the surrounding annular flow of the pulverous material to form a suspension from the gas and the pulverous material serves to protect the walls of the reaction chamber from the direct effects of the reaction gas.

2. The method of claim 1, further comprising causing the flow of the pulverous material to fall onto a conical sliding surface prior to flowing into the reaction chamber.

3. The method of claim 1, in which the meeting point of the annular flow of pulverous material and the reaction gas in the reaction chamber is selected by controlling the diameter of the annular flow of pulverous material.

4. The method of claim 1, in which the meeting point of the annular flow of pulverous material and the reaction gas in the reaction chamber is adjusted by altering the flare angle of the turbulent spray of the reaction gas.

5. An apparatus for forming a turbulent suspension from a pulverous material and reaction gas which is directed centrally downwards into a reaction chamber and comprising: a feed pipe for the pulverous material having the shape of a downwards converging cone; inside the feed pipe an axially mounted turbulence chamber at the upper section of which there is a stationary, adjustable turbulence generator having means for directing the gas into axial and tangential directions, the lower section of the turbulence chamber comprising a cylindrical stabilizing member with a diameter less than that of the turbulence chamber and means for distributing the pulverous material.

6. The apparatus of claim 5, comprising means for adjusting the setting of the turbulence generator to alter the proportion of the tangential flow to the axial flow.

7. The apparatus of claim 5 in which the ratio of the diameter of the cylindrical stabilizing member to the diameter of the turbulence chamber is within the range 0.2–0.8.

* * * * *